United States Patent [19]

Gaffney

[11] 4,079,735

[45] Mar. 21, 1978

[54] EMERGENCY AIR BREATHING ASSEMBLY FOR DIVERS

[76] Inventor: John P. Gaffney, 653 Roycroft, Long Beach, Calif. 90807

[21] Appl. No.: 763,893

[22] Filed: Jan. 31, 1977

[51] Int. Cl.[2] ..... A62B 7/00; B63C 11/16

[52] U.S. Cl. ..... 128/142.2; 128/145 A; 128/147

[58] Field of Search ..... 128/147, 145 A, 145 R, 128/142 R, 142.2, 142.3, 136, 208, 203; 138/89

[56] References Cited

U.S. PATENT DOCUMENTS

| | | | |
|---|---|---|---|
| 3,073,301 | 1/1963 | Hay et al. | 128/203 X |
| 3,768,465 | 10/1973 | Helmer | 128/136 |

FOREIGN PATENT DOCUMENTS

| | | | |
|---|---|---|---|
| 1,150,873 | 6/1963 | Germany | 128/142 R |

*Primary Examiner*—Robert W. Michell
*Assistant Examiner*—Henry J. Recla
*Attorney, Agent, or Firm*—C. A. Phillips

[57] ABSTRACT

A mouthpiece cover for covering and plugging a mouthpiece of an auxiliary breathing device while not in use and under water consisting of a generally elongated body member having a tapered, oval-shaped plug at one end, and adjacent to the plug there are two pairs of spaced arms extending outward from the body member which are adapted to engage flanges on the mouthpiece which, in use, support the mouthpiece inside the mouth of a wearer.

8 Claims, 3 Drawing Figures

EMERGENCY AIR BREATHING ASSEMBLY FOR DIVERS

BACKGROUND OF THE INVENTION

1. Field of the Invention

This invention relates to underwater diving equipment, and particularly to a device for protecting and keeping clean the interior of a diver's breathing apparatus when not in use.

2. General Description of the Prior Art

Diving, particularly scuba diving by amateur divers, has grown tremendously in popularity and is now a sport engaged in by numbers running into the hundreds of thousands. When proper precautions are taken, it is a relatively safe sport; however, when mistakes are made, it can be fatal. A primary problem, of course, is avoiding running out of air. If one is mindful of the usage and time in the water, this should not happen. However, distractions abound in seeing what there is to see below, and not infrequently divers do run out of air. If they are near the surface when this occurs, there should be little problem. Where such is not the case, and a diver is at significant depths or in an underwater cave or structure under water, a diver may find himself in real danger. If there is another diver at hand who does have an adequate air supply, and if the two of them keep cool and do not panic, it is possible for the one diver's mouthpiece, coupled to the then existing one air supply, to be passed back and forth between them while they return to the surface. Unfortunately, it is most difficult to act coolly in such an emergency, and thus perhaps too much to expect in a majority, or at least in many of such cases. In recognition of this, it has been proposed that diving backpacks be equipped with two breathing assemblies, each assembly including a conventional, demand type, second stage regulator and mouthpiece. There has been some acceptance of this idea, particularly by diving instructors, and some do carry a second breathing assembly. A difficulty is that of determining what to do with the auxiliary breathing assembly until it is needed, and then being sure that it is immediately available and operable. It will be appreciated that in order to be operable, the working portions of the second stage regulator, partially accessible through the mouthpiece, must be kept clear of foreign matter which might clog or otherwise foul the regulator and/or cause a diver to choke. Second, the assembly should ordinarily be out of the diver's way and thus not restrain or interfere with his normal activities. Third, the assembly should be readily deployable for use by another diver who needs air.

Accordingly, it is the object of this invention to solve the foregoing problems and to facilitate the acceptance and use of an auxiliary breathing assembly as standard diving equipment.

SUMMARY OF THE INVENTION

In accordance with this invention, a mouthpiece cover would be constructed which would include a plug for fitting into the air opening of a diver's mouthpiece and two pairs of oppositely positioned arms which would engage and lock the cover to flanges on the mouthpiece. Since mouthpieces are typically of rubber or other flexible material, the mouthpiece and cover can be separated by applying a separating force. By attaching the cover to a belt or strap worn by a diver when needed by another diver, the latter need only grasp the auxiliary mouthpiece and pull on it, freeing it from the cover at the same time it is pulled from its attachment, thus enabling the mouthpiece to be immediately used without any second operation.

DETAILED DESCRIPTION OF THE DRAWINGS

Figure 2:
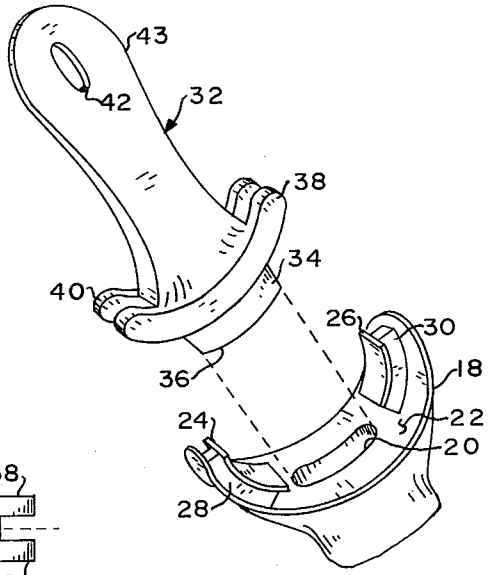
FIG. 2 is a pictorial view illustrating a mouthpiece and cover with these components separated.
Figure 3:
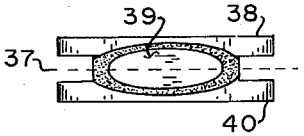
FIG. 3 is an end view of the mouthpiece cover.
Figure 1:
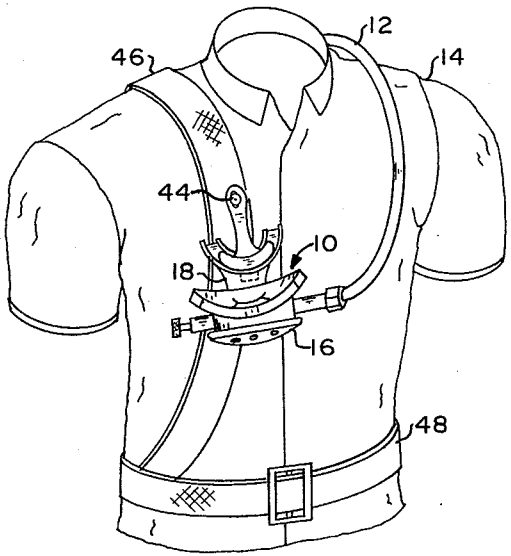
FIG. 1 is a pictorial illustration of an auxiliary breathing assembly with a cover inserted in it and attached to a shoulder strap of a user.

Referring to the drawings, auxiliary breathing assembly 10 is supplied air through hose 12 from a standard backpack air tank (not shown) on the back of wearer 14. For purposes of clarity, the basic breathing assembly is not shown.

Breathing assembly 10 consists basically of a standard second stage air pressure regulator 16, which is of the demand type, and mouthpiece 18, the two being made an integral unit. Regulator 16 receives air at a typically 100 to 160 PSI and supplies it at ambient pressure upon demand through opening 20 in mouthpiece 18, demand being indicated when a diver produces pressure by inhaling through the mouthpiece. Mouthpiece 18 is semi-cylindrical (in the round sense), having a mouth engaging surface 22 which, in use, rests against the outside of the lips of the user and flanges 24 and 26, which are generally concentric in configuration with that of mouth engaging surface 22. These flanges are supported by spacers 28 and 30 which support the flanges on mouth engaging surface 22 to form a mouth grip with the lips and teeth of the wearer gripped between flanges 24 and 26 and mouth engaging surface 22. (Each pair of locking arms straddles a plane bisecting the oval end of the cover along its major axis 37 and normal to the end surface 39 of the cover.)

Mouthpiece cover 32 is of an oval configuration in end region 34 and typically tapers slightly, being of smallest cross section at end 36. It is sized to fit into opening 20. A first and second pair of locking arms 38 and 40, on each of two opposite sides of cover 32, are adapted, when engaged with mouthpiece 18, to fit under flanges 24 and 26 and in engagement with mouth engaging surface 22. In this way, not only is mouthpiece cover 32 locked into position with tapered end 36 in opening 20 and thereby closing it off, but by virtue of the engagement of arms 38 and 40 with mouth engaging surface 22, a limited insertion of the cover is made into mouthpiece 18 and thus the two held stably together. An opening 42 in an opposite end region 43 (to that of tapered end region 34) enables cover 32 to be affixed to a button 44 on strap 46 (or on belt 48—no button being shown on belt 48).

In the event of an emergency situation where a person other than wearer 14 suddenly requires air, he would only have to grasp breathing assembly 10, pull on it, and it would be freed from cover 32 and be immediately usable. Since up to that point the breathing assembly had been protected from foreign matter by cover 32, it may be counted on to properly function.

Having thus disclosed my invention, what is claimed is:

1. An auxiliary and emergency breathing assembly comprising:

a demand type air pressure regulator;

supply means, including a hose attached to said regulator for supplying air to said regulator;

a strap to be worn about the body, and including connection means attached to the strap for making a connection to another object;

a mouthpiece coupled to said regulator, which mouthpiece includes:

a generally semi-circular mouth contacting region adapted to extend around the outside of the teeth of a wearer, a centrally positioned opening through which air is supplied to a wearer from said regulator, and a pair of concentrically positioned flanges spaced from and supported by said mouth contacting region on either side of said opening, which flanges fit into the mouth and enable the mouthpiece to be gripped;

a mouthpiece cover comprising:

a body member having a tapered cross section in an end region slidably mounted in said opening, said end region generally tapering to a decreased cross section at an end of said body member, first and second pairs of parallel spaced arms extending outward on opposite sides of and from said body member, releasably engaged about said flanges and said body member includes means for attachment to said connecting means of said strap;

whereby said tapered region of said body member would extend into and close the air opening in said mouthpiece, and said spaced arms would engage between said mouth contacting region and said flanges, effecting closure of said opening, generally blocking said cover against unintentional removal, and limiting penetration of said tapered region into said opening; and wherein, in an emergency, someone other than the wearer of said assembly could grasp said mouthpiece, causing it to be detached from said cover and thus be immediately usable for breathing.

2. An assembly as set forth in claim 1 wherein:

said tapered portion of said body member has an oval cross section; and said parallel spaced arms extending outward on opposite sides of and from said body member straddle a plane symmetrically along the major axis of the oval cross section of the body member and normal to its cross section.

3. An assembly as set forth in claim 2 wherein said means for attachment comprises an opening in said body member, and said connection means is a button.

4. A cover for a diver's mouthpiece, which mouthpiece includes a generally semi-cylindrical, semi-circular mouth contacting region adapted to extend around the outside of the teeth of the diver, a centrally positioned opening through which air is supplied, and a pair of concentrically positioned flanges spaced from and supported by the mouth contacting region on either side of said opening, which flanges fit into the mouth and enable the mouthpiece to be gripped, said cover comprising:

means adapted to slidably mount within said opening including a body member having a tapered, oval-shaped cross section in an end region, generally tapering to a decreased cross section at an end of said body member; and means adapted for engaging said flanges including first and second pairs of parallel spaced arms extending outward on opposite sides of and from said body member, and each said pair straddling a plane symmetrically along the major axis of the oval and cross section of the body and normal to the cross section;

whereby said tapered region of said body member would extend into and close the air opening in said mouthpiece, and said spaced arms would engage between said mouth contacting region and said flanges, effecting closure of said opening, generally blocking said cover against unintentional removal, and limiting further penetration of said tapered region into said opening.

5. A cover as set forth in claim 4 wherein said body member is generally elongated, and includes means positioned in an end region opposite to said first-named end region for attachment of said cover to another object.

6. A cover as set forth in claim 5 wherein said means for attachment comprises an opening in said body member, which said opening may be secured to a button.

7. A cover as set forth in claim 4 wherein each pair of said first and second pairs of parallel spaced arms effect a wider cross dimension than the parallel width minor axis dimension of the adjoining oval-shaped end region of said body member.

8. A cover as set forth in claim 7 further comprising:

a first arm extension interconnecting one each of said first and second pairs of parallel spaced arms, said arm so connected being on one side of said body member, and a second arm extension interconnecting the remaining arms of said first and second pairs of parallel spaced arms on the opposite side of said body member, and thereby effecting a continuous arm assembly on each side of said body member; and each said arm assembly is generally circular in configuration and is adapted to continuously engage said mouth contacting region.

* * * * *